US010239335B2

(12) United States Patent
Kato

(10) Patent No.: US 10,239,335 B2
(45) Date of Patent: Mar. 26, 2019

(54) PRINTING APPARATUS

(71) Applicant: TOSHIBA TEC KABUSHIKI KAISHA, Tokyo (JP)

(72) Inventor: Kazunori Kato, Izu Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/889,600

(22) Filed: Feb. 6, 2018

(65) Prior Publication Data

US 2018/0257411 A1 Sep. 13, 2018

(30) Foreign Application Priority Data

Mar. 7, 2017 (JP) ..... 2017-043046

(51) Int. Cl.

| | |
|---|---|
| ***B41J 29/17*** | (2006.01) |
| ***B41J 11/70*** | (2006.01) |
| ***B41J 2/32*** | (2006.01) |
| ***B41J 3/407*** | (2006.01) |

(52) U.S. Cl.

CPC ..... *B41J 29/17* (2013.01); *B41J 2/32* (2013.01); *B41J 3/4075* (2013.01); *B41J 11/703* (2013.01)

(58) Field of Classification Search

CPC ... B41J 29/17; B41J 2/32; B41J 11/703; B41J 3/4075

See application file for complete search history.

(56) References Cited

U.S. PATENT DOCUMENTS

| | | | | |
|---|---|---|---|---|
| 6,037,958 A * | 3/2000 | Terauchi | ..... | B41J 29/17 347/171 |
| 2004/0061768 A1 | 4/2004 | Nishimura | | |
| 2005/0200690 A1 | 9/2005 | Matsukawa | | |

FOREIGN PATENT DOCUMENTS

| | | |
|---|---|---|
| JP | S6015173 A | 1/1985 |
| JP | H08207323 A | 8/1996 |
| JP | H10119330 A | 5/1998 |
| JP | 2015-062986 A | 4/2015 |

OTHER PUBLICATIONS

Computer-generated translation of JP 08-207323, published on Aug. 1996.*

Computer-generated translation of JP 60-015173, published on Jan. 1985.*

Extended European Search Report dated Jul. 10, 2018, mailed in counterpart European Application No. 18156075.6, 8 pages.

* cited by examiner

*Primary Examiner* — Huan Tran

(74) *Attorney, Agent, or Firm* — Kim & Stewart LLP

(57) ABSTRACT

A printing apparatus performs printing on a sheet including adhesive label paper and includes a thermal head configured to perform printing on the sheet using heat, a platen roller which is positioned to face the thermal head, and configured to rotate to transport the sheet when the sheet is interposed between the thermal head and the platen roller, a heating unit configured to heat the thermal head, an output device, and a controller. The controller is configured to operate in a cleaning mode, in which the controller causes the thermal head to be heated to a predetermined temperature at which glue of the label paper is softened while the platen roller is in contact with the thermal head and rotating without transporting any sheet, and controls the output device to indicate that the thermal head has been heated up to the predetermined temperature and is ready for cleaning.

15 Claims, 8 Drawing Sheets

PRINTING APPARATUS

CROSS-REFERENCE TO RELATED APPLICATION

This application is based upon and claims the benefit of priority from Japanese Patent Application No. 2017-043046, filed Mar. 7, 2017, the entire contents of which are incorporated herein by reference.

FIELD

Embodiments described herein relate generally to a printing apparatus.

BACKGROUND

In a label printer in which printing is performed on adhesive label paper, there is a possibility that, when printing is repeatedly performed, glue which is applied to label paper may melt, and stick to a thermal head, a platen roller, a cutter, and the like, with which the label paper may come into contact. In addition, an amount of the glue which is stuck increases along with an increase in the number of printing times.

When glue sticks to the thermal head, there is a possibility of causing a deterioration in printing quality such as an occurrence of a blur in printed characters, as contact between the thermal head and the label paper becomes insufficient. In addition, when glue sticks to the thermal head or the platen roller, there is a possibility that paper may not be smoothly transported because the label paper may stick to the glue as it is being transported. Due to this, there is a possibility that wrinkles may occur in the label paper, or a cutting position may be shifted when the label paper is cut by a cutter. In addition, when glue sticks to the cutter, there is a possibility that a cutting failure of the label paper may occur. In this manner, since sticking of glue may have an influence on a normal operation of the label printer, an operator of the label printer checks the sticking state of glue on a regular basis, and performs a cleaning operation in which glue is removed.

Specifically, an operator of the label printer cleans the glue which is stuck to the cutter, or the like, using cleaning liquid, alcohol, or the like, causing the glue to soak into a cloth or swab. Alternatively, glue which is stuck to the thermal head, the platen roller, or the like, is removed by causing cleaning paper to pass through the label printer.

However, since glue which sticks to each unit of the label printer is hardened, and it is difficult to remove the glue, it is necessary to frequently clean the label printer. For this reason, a burden of the operator is increased.

DETAILED DESCRIPTION

Embodiments provide a printing apparatus in which it is possible to easily remove glue that has stuck to surfaces of internal units of the printing apparatus, and reduce a workload of an operator.

According to an embodiment, there is provided a printing apparatus which performs printing on a sheet including adhesive label paper. The printing apparatus includes a thermal head configured to perform printing on the sheet using heat, a platen roller which is positioned to face the thermal head, and configured to rotate to transport the sheet when the sheet is interposed between the thermal head and the platen roller, a heating unit configured to heat the thermal head, an output device, and a controller. The controller is configured to operate in a cleaning mode, in which the controller causes the thermal head to be heated to a predetermined temperature at which glue of the label paper is softened while the platen roller is in contact with the thermal head and rotating without transporting any sheet, and controls the output device to indicate that the thermal head has been heated up to the predetermined temperature and is ready for cleaning.

First Embodiment

Hereinafter, a label printer 10 as a first embodiment of the exemplary embodiment will be described with reference to accompanying drawings.

Descriptions of Entire Configuration of Label Printer

Figure 1:
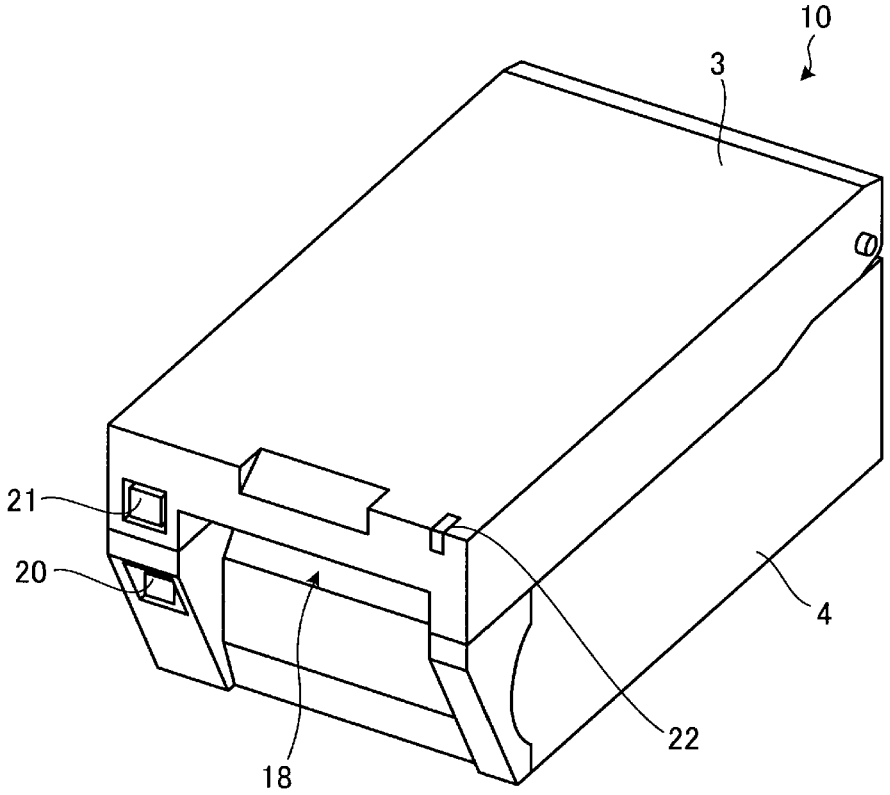
FIG. 1 is a perspective view which illustrates an appearance of a label printer according to an embodiment.

FIG. 1 is a perspective view which illustrates an appearance of the label printer 10 as a printing apparatus according to the embodiment. The label printer 10 is provided with an upper case 3, a lower case 4, a paper discharge port 18, a power supply switch 20, a feeding switch 21, and an indicator 22.

Figure 2:
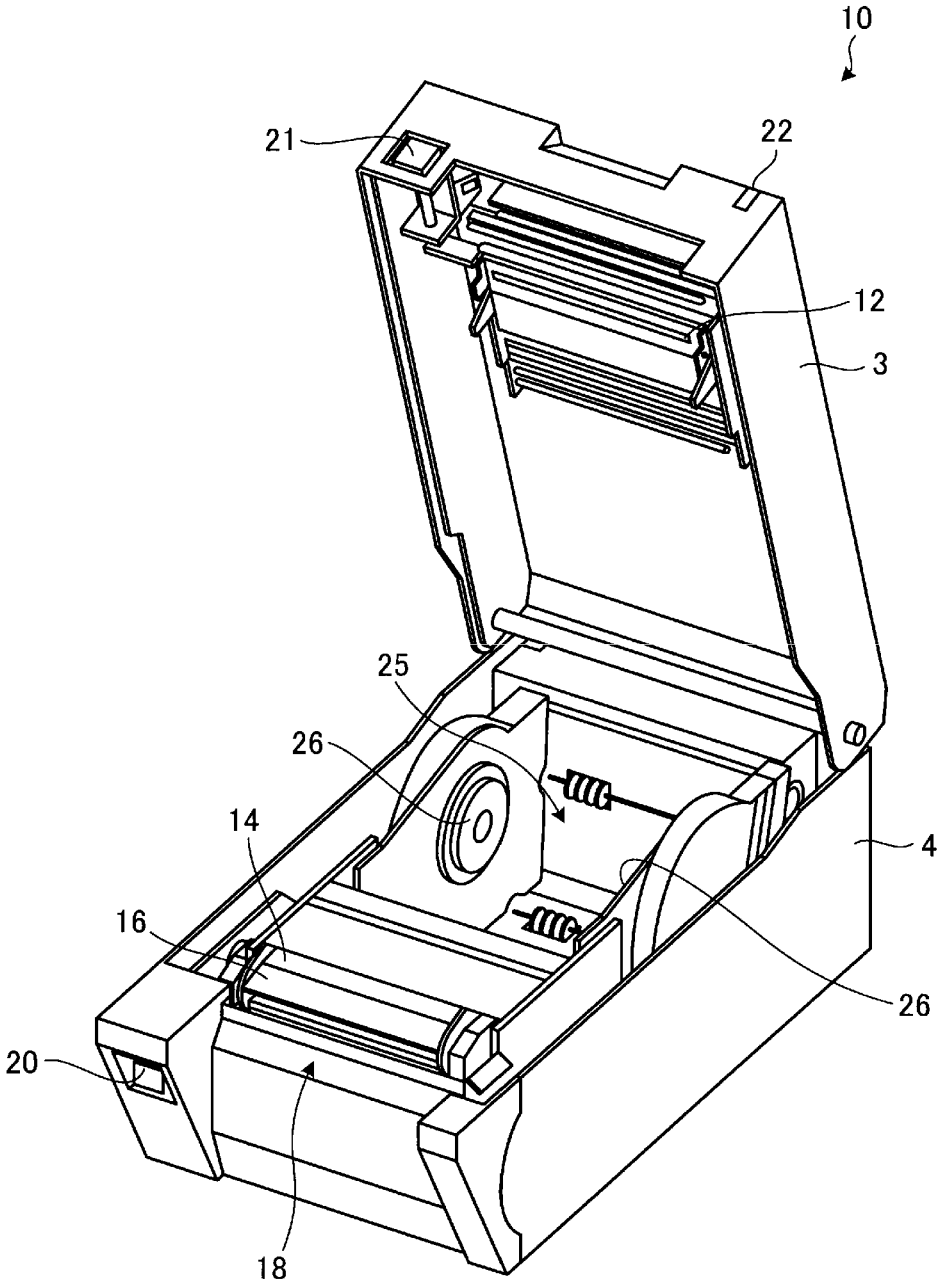
FIG. 2 is a perspective view which illustrates an open state of an upper case of the label printer.

FIG. 2 is a perspective view which illustrates an open state of the upper case 3 of the label printer 10. The label printer 10 is further provided with a thermal head 12, a platen roller 14, a cutter 16, and a sheet receiving portion 25.

The sheet receiving portion 25 is a space which is formed in a container shape of which a top face is open, receives roll paper (not illustrated) which is heat sensitive paper obtained by winding belt-like paper in a roll shape, and holds the roll paper. As the roll paper, for example, there is a receipt roll or a label roll. The receipt paper is obtained by winding belt-like paper which will become a receipt. The label roll is formed by winding mount with label which is obtained by attaching label paper P (refer to FIG. 3) formed by applying glue to a rear face thereof to a belt-like mount.

The label printer 10 according to the embodiment is used in a state in which a label roller around which the label paper P is wound is loaded. Both ends of the label roller are held by a holding unit 26, respectively, which is illustrated in FIG. 2, and the label roller is received and held in the sheet receiving portion 25. In addition, in the label printer 10, the sheet receiving portion 25 receives cleaning paper in a cleaning mode in which portions to which the label paper P comes into contact are cleaned.

The lower case 4 is a parallelepiped case of which a top face is open, and the top face is closed by the upper case 3. In addition, a connecting terminal (not illustrated) which is used when connecting the label printer 10 and an external device, a power supply terminal (not illustrated) which supplies power to the label printer 10, or the like, is provided in the lower case 4.

A side on the rear face of the upper case 3 is hingedly attached to the lower case 4, and the top face of the lower case 4 is opened or closed along with a rotation of the upper case 3.

The paper discharge port 18 from which the label paper P is discharged is provided between a front end lower part of the upper case 3 and a front end upper part of the lower case 4.

The power supply switch 20 is a switch for performing power-on and power-off of the label printer 10 when pressed. The feeding switch 21 is a switch which transports the label paper P from the sheet receiving portion 25 side to the paper discharge port 18 side by a predetermined amount, when pressed. The indicator 22 includes, for example, an LED, and displays a state of the label printer 10 including an input state of a power supply, by being turned on, or by blinking.

Figure 3:
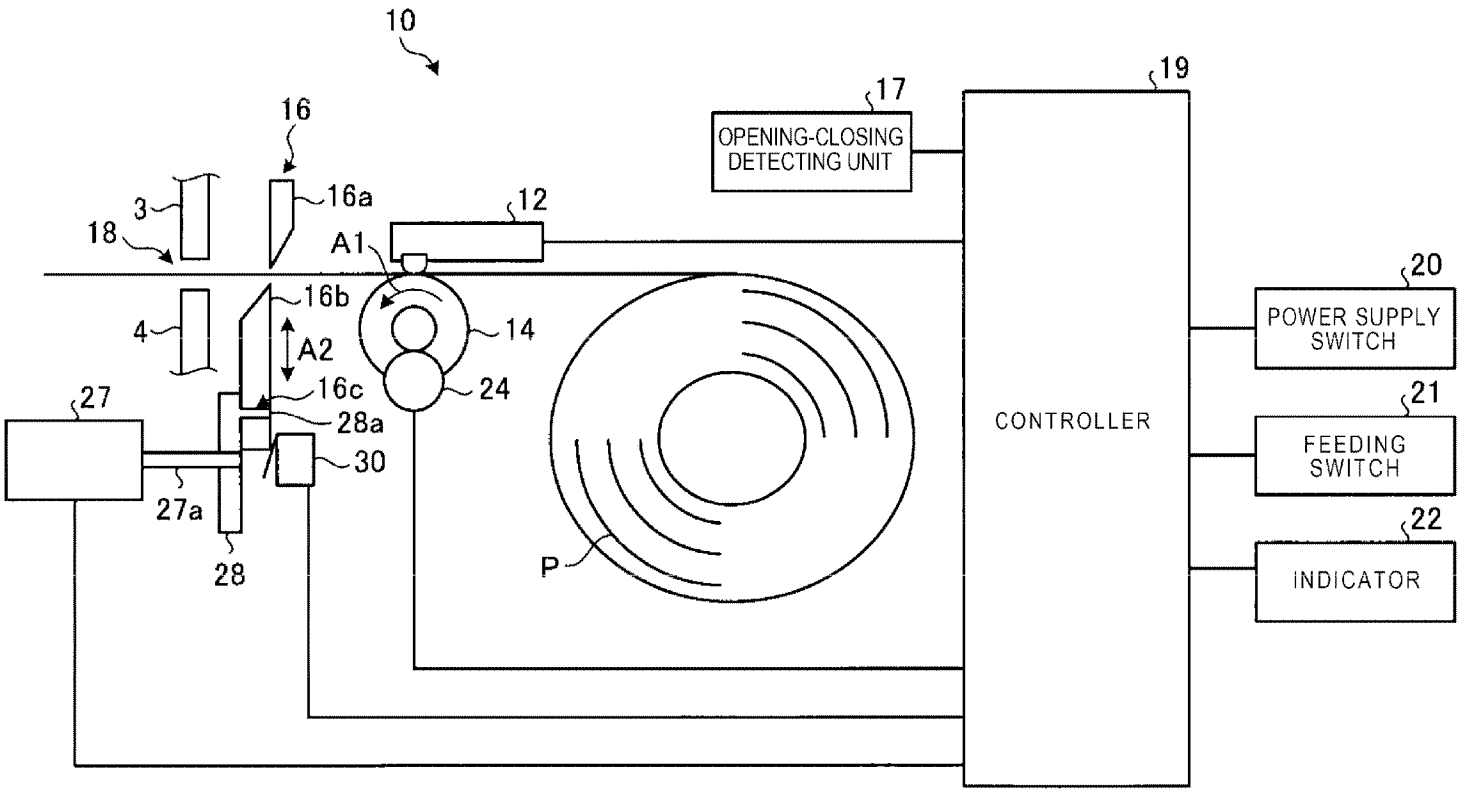
FIG. 3 is a schematic view which describes a schematic configuration of the label printer, and a transport state of label paper.

In addition, though it is not illustrated in FIGS. 1 and 2, the label printer 10 is provided with an opening-closing detecting unit 17 (refer to FIG. 3). The opening-closing detecting unit 17 is executed by a sensor which is provided with an electrical contact which is electrically connected and comes into contact with the lower case 4, when the upper case 3 is closed, and is electrically disconnected and is separated from the lower case 4, when the upper case 3 is opened.

According to the embodiment, when the power supply switch 20 is turned on by pressing the power supply switch 20 for a longer amount of time than normal, a start of a cleaning mode in which portions of the label printer 10 with which the label paper P comes into contact is cleaned, is instructed to the label printer 10. A detail thereof will be described later.

According to the embodiment, when the label printer 10 is in the cleaning mode, the platen roller 14 is rotated while separated from the thermal head 12 using an operation of the feeding switch 21. In this manner, it enters a state in which cleaning of the surface of the platen roller 14 is easily performed. In addition, a rotation of the platen roller 14 is stopped by operating the feeding switch 21 while the platen roller 14 rotates. In this manner, a cleaning state of the platen roller 14 ends. This will be described in detail later.

According to the embodiment, when the label printer 10 is in the cleaning mode, the indicator 22 provides an indication that the label printer 10 is in the cleaning mode, for example, the thermal head 12 is heated up to a predetermined temperature, or the like. This will be described in detail later.

In the label printer 10, the thermal head 12 is fixed to an inner face of the upper case 3, and comes into close contact with the platen roller 14 when the upper case 3 is closed.

The thermal head 12 is provided with a plurality of heating elements which are aligned, and performs printing on the label paper P which is interposed between the platen roller 14 and the thermal head using heat generated by the heating elements. More specifically, the thermal head 12 has a structure in which the plurality of heating elements are mounted on a glass substrate or a ceramic substrate. The thermal head 12 performs printing on the label paper P by causing a heating element at a position corresponding to printing data to generate heat, from among the plurality of heating elements. In addition, a thermistor as a temperature detecting element is built in the thermal head 12, and a temperature of the thermal head 12 is monitored by the thermistor. The thermal head 12 weakens an adhesive force of glue which is stuck to the surface, by making the glue soft by heating thereof, when the label printer 10 is in the cleaning mode. This will be described in detail later.

The platen roller 14 rotates due to a transmission of a driving force of a stepping motor 24 (refer to FIG. 3), and transports the label paper P interposed between the thermal head 12 and the platen roller 14 from the sheet receiving portion 25 on the upstream side to the paper discharge port 18 on the downstream side.

The cutter 16 is an example of a cutting unit, and cuts the printed label paper P for each label.

Descriptions of Transport Path of Label Paper

FIG. 3 is a schematic view which describes a schematic configuration of the label printer 10 and a transport state of the label paper P. Hereinafter, a state in which the label paper P is transported inside the label printer 10 will be described, using FIG. 3.

As illustrated in FIG. 3, the label paper P which is received in a roll shape is transported while being interposed between the thermal head 12 and the platen roller 14. At this time, the platen roller 14 rotates in a direction of the arrow A1 (counterclockwise direction) on a paper plane in FIG. 3, using the stepping motor 24 in a state of being in pressure-contact by the thermal head 12. Accordingly, as described above, the label paper P is transported from the sheet receiving portion 25 on the upstream side to the paper discharge port 18 on the downstream side.

The label paper P reaches the cutter 16 after passing through a portion between the thermal head 12 and the platen roller 14. As illustrated in FIG. 3, the cutter 16 is provided with an upper blade 16*a* as a fixed blade, and a lower blade 16*b* as a movable blade. In addition, the label paper P is cut when it is interposed between the upper blade 16*a* and the lower blade 16*b* and the lower blade 16*b* moves upward. The lower blade 16*b* moves downward after cutting the label paper P. That is, the lower blade 16*b* reciprocates in the direction of an arrow A2.

The lower blade 16*b* reciprocates along with a rotation of a stepping motor 27. A disk-shaped cam 28 is attached to a tip end of a rotating shaft 27*a* of the stepping motor 27, and a pin 28*a* which is attached to the cam 28 is inserted into a groove 16*c* which is formed in the lower blade 16*b*. In addition, due to a rotational movement of the stepping motor 27, the pin 28*a* causes the lower blade 16*b* to reciprocate in the direction of the arrow A2. In addition, a vertical position of the lower blade 16*b* is measured by a position sensor 30. Since the stepping motor 27 stops rotating based on an output of the position sensor 30, the lower blade 16*b* stops at a predetermined position after cutting the label paper P. In addition, a mechanism of reciprocating of the lower blade 16*b* will be described in detail later.

The cut label paper P is discharged from the paper discharge port 18 which is formed at a gap between the upper case 3 and the lower case 4.

In addition, a controller 19 provided in the label printer 10 has a configuration of a general computer, and manages a control of the entire operation of the label printer 10 by executing a control program which is stored therein. That is, the controller 19 receives print data from a POS terminal, or the like (not illustrated in FIG. 3), which is connected to the label printer 10, and executes a printing operation.

The controller 19 controls operations of the thermal head 12, and the stepping motors 24 and 27. In addition, the controller 19 monitors a location of the lower blade 16*b* of the cutter 16 by receiving an output of the position sensor 30, and monitors an opening-closing state of the upper case 3 by receiving an output of the opening-closing detecting unit 17. In addition, the controller 19 monitors operation states of the power supply switch 20 and the feeding switch 21, and controls the indicator 22.

Descriptions of Operation of Cutter

Figure 4:
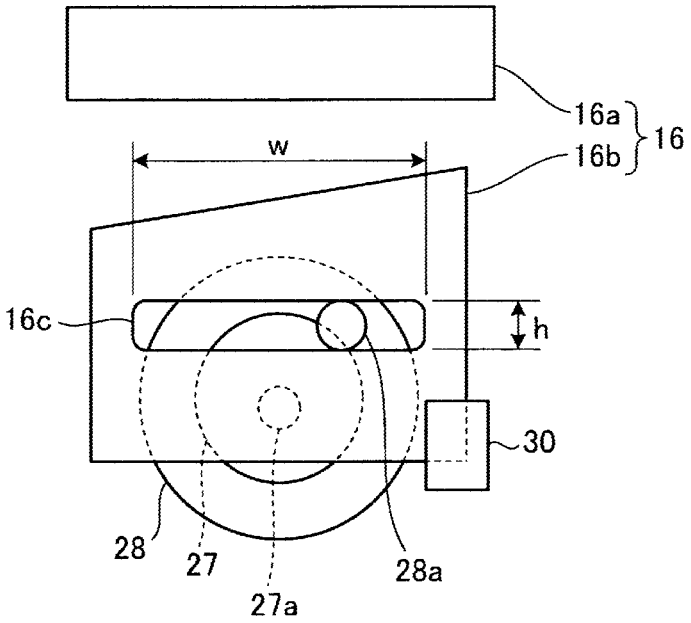
FIG. 4 is a schematic view which illustrates a cutting mechanism of a cutter.

FIG. 4 is a schematic view which illustrates a cutting mechanism of the cutter 16. In addition, FIG. 4 illustrates a state of the cutter 16 which is viewed from the upstream side of the transport path of the label paper P. As illustrated in FIG. 4, the lower blade 16*b* of the cutter 16 is driven by the above described stepping motor 27, the cam 28 and the pin 28*a* provided in the cam 28. In addition, a vertical position of the lower blade 16*b* is monitored by the position sensor 30.

The cam 28 has the pin 28*a* at a position separated from a rotation center to which a rotating shaft 27*a* of the stepping motor 27 is attached. That is, the cam 28 and the pin 28*a* form an eccentric mechanism. The pin 28*a* is inserted into the groove 16*c* which is formed at the lower blade 16*b*.

The groove 16*c* which is formed at the lower blade 16*b* is formed in a rectangular shape. A height h of the groove 16*c* is approximately the same as a diameter of the pin 28*a*. Meanwhile, a width w of the groove 16*c* is approximately the same as a diameter of a circular orbit which is drawn by the pin 28*a* when the cam 28 rotates.

Accordingly, when the stepping motor 27 rotates due to an instruction from the controller 19 (refer to FIG. 3), the pin 28*a* provided in the cam 28 performs a circular movement in which a circular orbit is drawn. At this time, the lower blade 16*b* reciprocates in the vertical direction according to a circular movement of the pin 28*a* which is inserted into the groove 16*c*. That is, the lower blade 16*b* is thrust upward toward the upper blade 16*a* from a home position as the lowest position, for example, and is engaged with the upper blade 16*a* in order from a high side of an edge of the lower blade 16*b*. For this reason, the label paper P which passes through the portion between the lower blade 16*b* and the upper blade 16*a* is successively cut from one end side toward the other end side.

The position sensor 30 detects whether or not the lower blade 16*b* is at the home position. The position sensor 30 outputs a signal indicating an ON state when the lower blade 16*b* is located at the home position as the lowest position, and output a signal indicating an OFF state when the lower blade 16*b* is not located at the home position as the lowest position. That is, the position sensor 30 is a sensor which detects that the lower blade 16*b* cuts the label paper P, and returns to the home position. In this manner, the controller 19 detects a start and an end of cutting of the label paper P, by receiving a signal from the position sensor 30.

Descriptions of Cleaning Mode

Subsequently, the cleaning mode in the label printer 10 will be described. The label printer 10 is provided with a thermal head cleaning mode in which the thermal head 12 is cleaned, a platen roller cleaning mode in which the platen roller 14 is cleaned, and a cutter cleaning mode in which the cutter 16 is cleaned. The thermal head, the platen roller, and the cutter are all portions with which the label paper P comes into contact with in a printing operation. According to the embodiment, before the label printer 10 transitions to the cleaning mode, the label printer transitions to the thermal head cleaning mode, first. In addition, the label printer transitions to the platen roller cleaning mode after the thermal head cleaning mode ends. In addition, the label printer transitions to the cutter cleaning mode after the platen roller cleaning mode ends. Thereafter, the label printer exits out of the cleaning mode.

Before transitioning to the thermal head cleaning mode, the label printer 10 heats the thermal head 12 up to a predetermined temperature (for example, 25° C. to 40° C.) in which hardened glue which may be stuck to the surface of the thermal head 12 is softened, by energizing the thermal head 12. Since an adhesive force of the glue which is softened by being warmed, decreases, it is possible to easily remove the glue using cloth, or the like, into which alcohol, or the like, is soaked. In addition, the surface of the thermal head 12 is also heated up to the above described predetermined temperature at the same time, by rotating the platen roller 14 while it is in contact with the thermal head 12, in the middle of heating of the thermal head 12. At this time, a transport of a sheet such as label paper or printing paper is not performed. That is, since the platen roller 14 rotates while in contact with the thermal head 12, the surface of the platen roller 14 is also heated up to the predetermined temperature. When the thermal head 12 is heated up to the predetermined temperature, and the thermistor built in the thermal head 12 detects that the temperature of the thermal head reaches the predetermined temperature, heating of the thermal head 12 is finished. At this time, the label printer 10 stops a rotation of the platen roller 14.

When the upper case 3 is opened in a state in which the thermal head 12 is heated, the thermal head 12 enters a state in which the surface thereof is exposed, that is, a state in which it is easy to clean the thermal head 12. This is the state of the thermal head cleaning mode. At this time, the operator of the label printer 10 cleans the surface of the thermal head 12 using cloth, or the like, into which alcohol, or the like, is soaked. At this time, since the surface of the thermal head 12 is heated up to the predetermined temperature, any glue which is stuck to the surface of the thermal head 12 would be softened by being warmed, and it is possible to easily remove the glue.

Subsequently, when the feeding switch 21 is pressed while the upper case 3 is opened, the platen roller 14 rotates independently, that is, while it is not in contact with the thermal head 12. In addition, the label printer 10 transitions to the state in which the surface of the platen roller 14 is easily cleaned, that is, the platen roller cleaning mode. At this time, the operator of the label printer 10 cleans the surface of the platen roller 14 which is rotating, using cloth, or the like, into which alcohol, or the like, is soaked. Since the surface of the platen roller 14 is heated, any glue which is stuck to the surface of the platen roller 14 would be softened by being warmed, and the glue can be easily removed. In addition, since the platen roller 14 is rotating, it is possible to clean the platen roller 14 over is entire circumference, by pressing cloth, or the like, to the portion of the platen roller 14 which is exposed to the surface, and keeping the cloth pressed while the platen roller 14 rotates.

When pressing the feeding switch 21 after cleaning of the platen roller 14 has ended, the platen roller 14 stops rotating and the platen roller cleaning mode is ended. In addition, when the upper case 3 is closed thereafter, the cleaning mode transitions to the cutter cleaning mode in which it is easy to clean the cutter 16.

In the cutter cleaning mode, if a printing sheet is transported to the label printer 10, the cutter 16 is continuously operated. In this manner, the transported printing sheet is cut, and any glue which is stuck to the surface of the cutter 16 is removed. At this time, a cleaning sheet (e.g., a sheet exclusively used for cleaning) may be transported instead of the printing sheet. In the cleaning sheet, there are a wet type obtained by containing a cleaning solution such as alcohol in a thin paper-shaped substrate, and a dry type obtained by containing an extremely fine abrasive on the surface of a thin paper-shaped substrate; however, it is possible to remove the glue which is stuck to the surface of the cutter 16 using a cleaning sheet of either type. In addition, when transporting a printing sheet or the cleaning sheet, since these sheets come into contact with the thermal head 12 and the platen roller 14, it is possible to clean the surfaces of the thermal head 12 and the platen roller 14 again, which have already been subjected to cleaning once.

Descriptions of State Transition Label Printer

Figure 5:
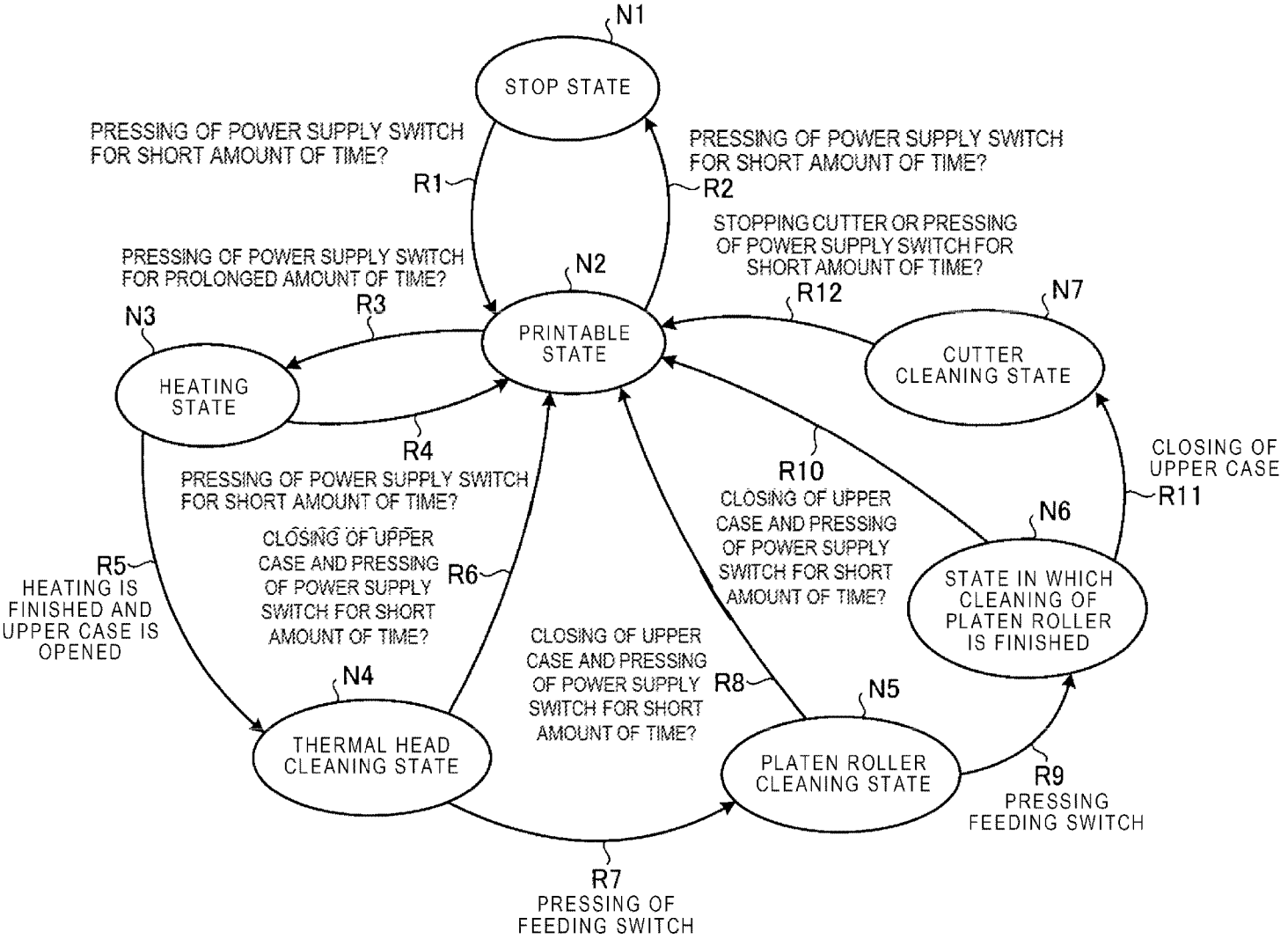
FIG. 5 is a state transition diagram which illustrates a transition of an operation state of the label printer according to a first embodiment.

Subsequently, a state transition of the label printer 10 will be described with reference to FIG. 5. FIG. 5 is a state transition diagram which illustrates a state transition of an operation of the label printer 10 according to the first embodiment.

The label printer 10 has states of seven types which are illustrated as nodes in the state transition diagram in FIG. 5. That is, a stop state N1, a printable state N2, a heating state N3, a thermal head cleaning state N4, a platen roller cleaning state N5, a state N6 in which cleaning of the platen roller is finished, and a cutter cleaning state N7.

The stop state N1 is a state in which a power supply of the label printer 10 is stopped.

The printable state N2 is a state in which the power supply of the label printer 10 is input, and a state in which printing can be executed when the controller 19 instructs a start of printing.

The heating state N3 is a state in which the thermal head 12 and the platen roller 14 are being heated. When it is the heating state N3, the platen roller 14 rotates while in contact with the thermal head 12.

The thermal head cleaning state N4 is a state in which heating of the thermal head 12 and the platen roller 14 are finished, a rotation of the platen roller 14 is stopped, and the upper case 3 is opened. In this state, the operator of the label printer 10 can clean the surface of the thermal head 12.

The platen roller cleaning state N5 is a state in which the upper case 3 is opened, and the platen roller 14 is rotating while separated from the thermal head 12. In this state, the operator of the label printer 10 can clean the surface of the platen roller 14.

The state N6 in which cleaning of the platen roller is finished is a state in which a rotation of the platen roller 14 is stopped.

The cutter cleaning state N7 is a state in which the upper case 3 is closed, and a state in which a printing sheet or a cleaning sheet is transported by rotating the platen roller 14, and the cutter 16 is repeatedly operated.

The label printer 10 transitions to the printable state N2 when the power supply switch 20 is pressed for a short amount of time when in the stop state N1 (Arc R1). In addition, while in the printable state N2, the label printer transitions to the stop state N1 under a condition that the power supply switch 20 is pressed for the short amount of time (Arc R2).

In addition, while in the printable state N2, the label printer 10 transitions to the heating state N3 under a condition that the power supply switch 20 is pressed for a prolonged amount of time (which is longer than the short amount of time) (Arc R3).

While in the heating state N3, the label printer 10 transitions to the printable state N2 when the cleaning mode ends, when the power supply switch 20 is pressed for a short amount of time (Arc R4).

In addition, while in the heating state N3, the label printer 10 transitions to the thermal head cleaning state N4, when heating is finished, and the upper case 3 is opened (Arc R5).

While in the thermal head cleaning state N4, the label printer 10 transitions to the printable state N2, when the upper case 3 is closed, and the power supply switch 20 is pressed for a short amount of time (Arc R6).

In addition, while in the thermal head cleaning state N4, the label printer 10 transitions to the platen roller cleaning state N5, when the feeding switch 21 is pressed (Arc R7).

While in the platen roller cleaning state N5, the label printer 10 transitions to the printable state N2, when the upper case 3 is closed, and the power supply switch 20 is pressed for a short amount of time (Arc R8).

In addition, while in the platen roller cleaning state N5, the label printer 10 transitions to the state N6 in which cleaning of the platen roller is ended, when the feeding switch 21 is pressed (Arc R9).

While in the state N6 in which cleaning of the platen roller is ended, the label printer 10 transitions to the printable state N2, when the upper case 3 is closed, and the power supply switch 20 is pressed for a short amount of time (Arc R10).

In addition, while in the state N6 in which cleaning of the platen roller is ended, the label printer 10 transitions to the cutter cleaning state N7, when the upper case 3 is closed (Arc R11).

While in the cutter cleaning state N7, the label printer 10 transitions to the printable state N2, when the operation of the cutter 16 is stopped or the power supply switch 20 is pressed for a short amount of time (Arc R12).

Descriptions of Processing Flow of First Embodiment

Figure 6:
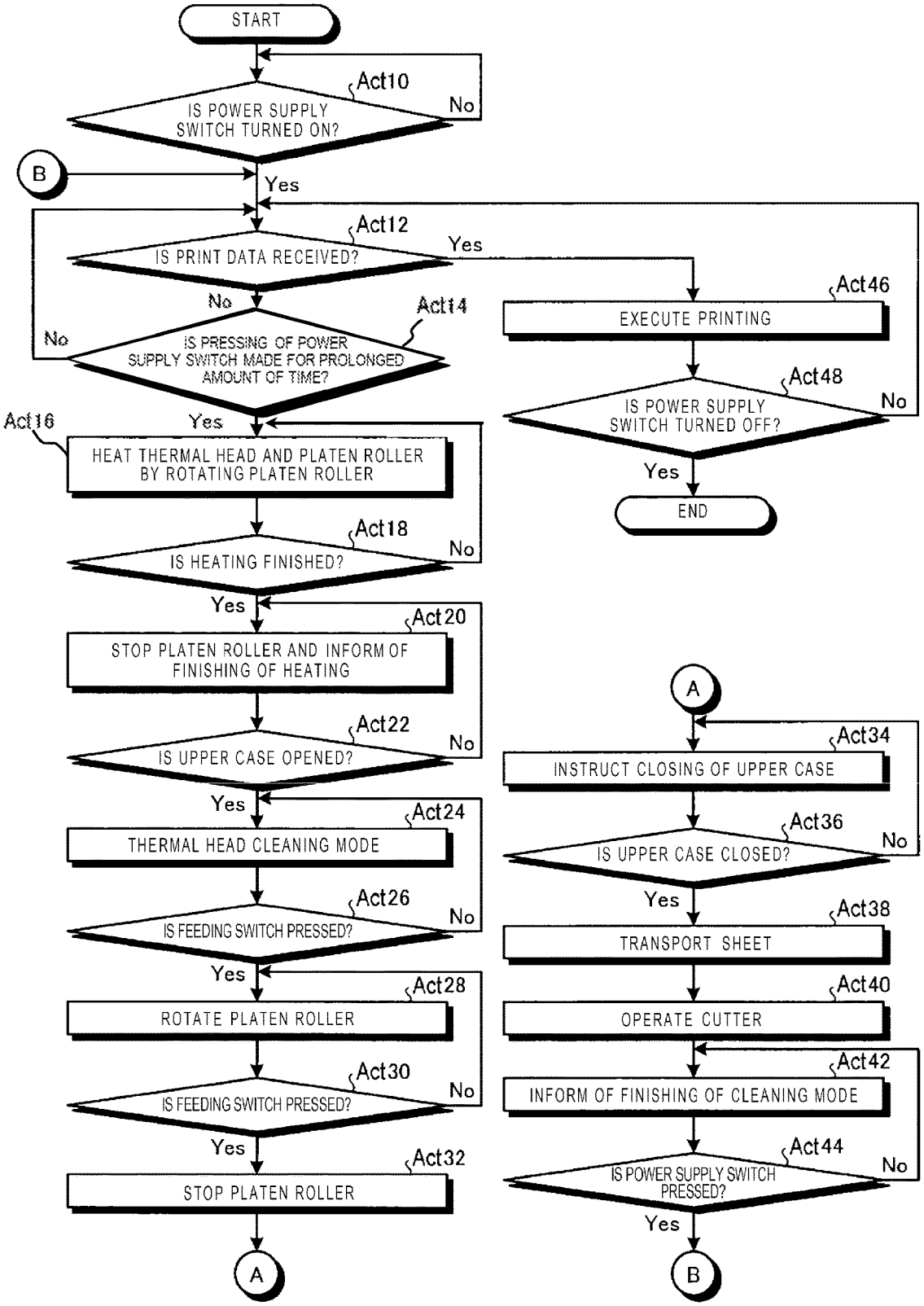
FIG. 6 is a flowchart which illustrates a series of flow of a cleaning mode according to the first embodiment.

Subsequently, a flow of the cleaning mode performed by the label printer 10 according to the first embodiment will be described using FIG. 6. FIG. 6 is a flowchart which illustrates a series of flow of the cleaning mode in the first embodiment. In addition, the steps of the flowchart in FIG. 6 are executed by the above described controller 19 (refer to FIG. 3).

The controller 19 determines whether the power supply switch 20 is in ON state, that is, whether the operator of the label printer 10 turned on the power supply switch 20 (ACT 10). When the power supply switch 20 is turned on (Yes in ACT 10), the controller proceeds to ACT 12 (corresponding to Arc R1 in FIG. 5). On the other hand, when the power supply switch 20 is turned off (NO in ACT 10), the controller repeats ACT 10.

In ACT 10, when the power supply switch 20 is turned on (Yes in ACT 10), the controller 19 checks whether print data is received from the POS terminal, for example, to which is the label printer 10 is connected (ACT 12). When the print data is received (Yes in ACT 12), the controller proceeds to ACT 46. On the other hand, when the print data is not received (No in ACT 12), the controller proceeds to ACT 14.

In ACT 12, when the print data is not received (No in ACT 12), the controller 19 determines whether the power supply switch 20 is pressed for a prolonged amount of time (ACT 14). When the power supply switch 20 is pressed for the prolonged amount time (Yes in ACT 14), the controller proceeds to ACT 16 (corresponding to Arc R3 in FIG. 5). In addition, the controller 19 causes the thermal head 12 to be heated and the platen roller 14 to come into contact with the thermal head 12 (ACT 16). In addition, in ACT 14, when the power supply switch 20 is not pressed for the prolonged amount of time (No in ACT 14), the controller returns to ACT 12.

Subsequently, the controller 19 determines whether heating of the thermal head 12 is finished, that is, whether the thermal head is heated up to a predetermined temperature (ACT 18). Specifically, the controller 19 determines whether the thermal head 12 reached the predetermined temperature (for example, 25° C. to 40° C.) by monitoring an output of the thermistor which is built in the thermal head 12. When heating of the thermal head 12 is finished (Yes in ACT 18), the controller proceeds to ACT 20. On the other hand, when heating of the thermal head 12 is not finished (No in ACT 18), the controller returns to ACT 16.

When heating of the thermal head 12 is finished (Yes in ACT 18), the controller 19 stops the rotation of the platen roller 14, and outputs an indication of ending of heating of the thermal head 12 by causing the indicator 22 to blink using a predetermined pattern (ACT 20).

The controller 19 determines whether the upper case 3 is opened by monitoring an output of the opening-closing detecting unit 17 (ACT 22). When the upper case 3 is opened (Yes in ACT 22), the controller 19 proceeds to ACT 24 (corresponding to Arc R5 in FIG. 5). On the other hand, when the upper case 3 is not opened (No in ACT 22), the controller 19 returns to ACT 20.

Since the surface of the thermal head 12 is exposed when the upper case 3 is opened in ACT 22, the label printer 10 enters the thermal head cleaning mode in which the thermal head 12 can be easily cleaned (ACT 24). At this time, the operator of the label printer 10 cleans the surface of the thermal head 12 using cloth, or the like, is which alcohol is contained.

The controller 19 determines whether the feeding switch 21 is pressed (ACT 26). When the feeding switch 21 is pressed (Yes in ACT 26), the controller proceeds to ACT 28 (corresponding to Arc R7 in FIG. 5). On the other hand, when the feeding switch 21 is not pressed (No in ACT 26), the controller returns to ACT 24.

The controller 19 rotates the platen roller 14 by rotating the stepping motor 24 (ACT 28). At this time, the label printer 10 enters the platen roller cleaning mode in which the platen roller 14 can be easily cleaned, since the platen roller 14 rotates while separated from the thermal head 12. At this time, the operator of the label printer 10 cleans the surface of the platen roller 14 which is rotating, using cloth, or the like, in which alcohol is contained.

The controller 19 determines whether the feeding switch 21 is pressed (ACT 30). When the feeding switch 21 is pressed (Yes in ACT 30), the controller proceeds to ACT 32 (corresponding to Arc R9 in FIG. 5). On the other hand, when the feeding switch 21 is not pressed (No in ACT 30), the controller returns to ACT 28.

In ACT 30, when the feeding switch 21 is pressed (Yes in ACT 30), the controller 19 stops the rotation of the platen roller 14 (ACT 32). In addition, the controller 19 outputs an instruction to close the upper case 3, by causing the indicator 22 to blink using a predetermined pattern (ACT 34).

The controller 19 determines whether the upper case 3 is closed by monitoring an output of the opening-closing detecting unit 17 (ACT 36). When the upper case 3 is closed (Yes in ACT 36), the controller proceeds to ACT 38 (corresponding to Arc R11 in FIG. 5). On the other hand, when the upper case 3 is not closed (No in ACT 36), the controller returns to ACT 34.

The controller 19 controls rotation of the platen roller 14 to transport the sheet (printing sheet or cleaning sheet) (ACT 38). In addition, since the upper case 3 is closed while in ACT 38, the thermal head 12 and the platen roller 14 are in contact with each other, and it is possible to transport the sheet interposed therebetween.

In addition, the controller 19 operates the cutter 16 (ACT 40). At this time, it is preferable that the controller 19 repeatedly operate the cutter 16 a plurality of times. In this manner, the label printer 10 transitions to the cutter cleaning mode in which any glue which is stuck to the cutter 16 can be removed. In addition, a sheet which is cut by the cutter 16 is discharged from the paper discharge port 18.

When the operation of the cutter 16 is finished, the controller 19 outputs an indication that the cleaning mode ended by causing the indicator 22 to blink using a predetermined pattern (ACT 42).

The controller 19 determines whether the power supply switch 20 is pressed for a short amount of time (ACT 44). When the power supply switch 20 is pressed for the short amount of time (Yes in ACT 44), the controller proceeds to ACT 12 (corresponding to Arc R12 in FIG. 5). On the other hand, when the power supply switch 20 is not pressed (No in ACT 44) for the short amount of time, the controller returns to ACT 42.

In the above described ACT 12, when the label printer 10 receives print data (Yes in ACT 12), the controller 19 executes printing of the print data (ACT 46).

Subsequently, the controller 19 checks a state of the power supply switch 20, and determines whether the power supply switch 20 is in the OFF state, that is, whether the operator of the label printer 10 turned off the power supply switch 20 (ACT 48). When the power supply switch 20 is in the OFF state (Yes in ACT 48), the controller finishes the processing in FIG. 6 (corresponding to Arc R2 in FIG. 5). On the other hand, when the power supply switch 20 is not turned off (No in ACT 48), the controller returns to ACT 12.

Though it is not described in FIG. 6, when the power supply switch 20 is pressed for a short amount of time in the middle of heating the thermal head 12 and the platen roller 14 (ACT 16), the controller proceeds to ACT 12 (corresponding to Arc R4 in FIG. 5). In addition, when the power supply switch 20 is pressed for a short amount of time in a case in which the upper case 3 is opened, the controller proceeds to ACT 12, when the upper case 3 is closed (corresponding to Arcs R6, R8, and R10 in FIG. 5).

As described above, according to the label printer 10 in the first embodiment, when a start of the cleaning mode in which the portion with which a sheet comes into contact is cleaned is instructed by pressing the power supply switch 20 for a prolonged amount of time, the controller 19 heats the thermal head 12 and the platen roller 14 up to a predetermined temperature at which any glue of the label paper P which is stuck to the thermal head 12 and the platen roller 14 is softened, without transporting the sheet. In addition, the indicator 22 provides an indication of the fact that the thermal head 12 and the platen roller 14 are heated up to a predetermined temperature. Accordingly, since it is possible to know a timing in which the glue which is stuck to the thermal head 12 and the platen roller 14 becomes easy to remove, it is possible to reduce a workload of the operator who performs a cleaning operation of the label printer 10.

According to the label printer 10 in the first embodiment, the thermal head 12 and the platen roller 14 are rotated while separated from each other, when the feeding switch 21 is operated. Accordingly, since the platen roller 14 rotates while its surface is exposed, it is possible to set the platen roller 14 to a state in which the platen roller 14 is easily cleaned. In addition, by operating the feeding switch 21 again, the rotation of the platen roller 14 is stopped. Accordingly, it is possible to finish the state in which the platen roller 14 is easily cleaned, reliably and easily.

In addition, according to the label printer 10 in the first embodiment, the cutter 16 as the cutting unit cuts a sheet which is transported according to a rotation of the platen roller 14. Accordingly, it is possible to reliably and easily remove glue which is stuck to the cutter 16.

Second Embodiment

Subsequently, as a second embodiment of the exemplary embodiment, a label printer 10*a* (not illustrated) as an example of the printing apparatus will be described. Since a hardware configuration of the label printer 10*a* is the same as the label printer 10 in the first embodiment, descriptions thereof will be omitted.

The label printer 10*a* performs cleaning of each unit of the label printer 10*a* using a method different from that of the label printer 10 in the first embodiment. Specifically, the label printer 10*a* performs cleaning of each unit of thermal head 12, the platen roller 14, and the cutter 16, without cleaning work performed by the operator.

Descriptions of State Transition of Label Printer

Figure 7:
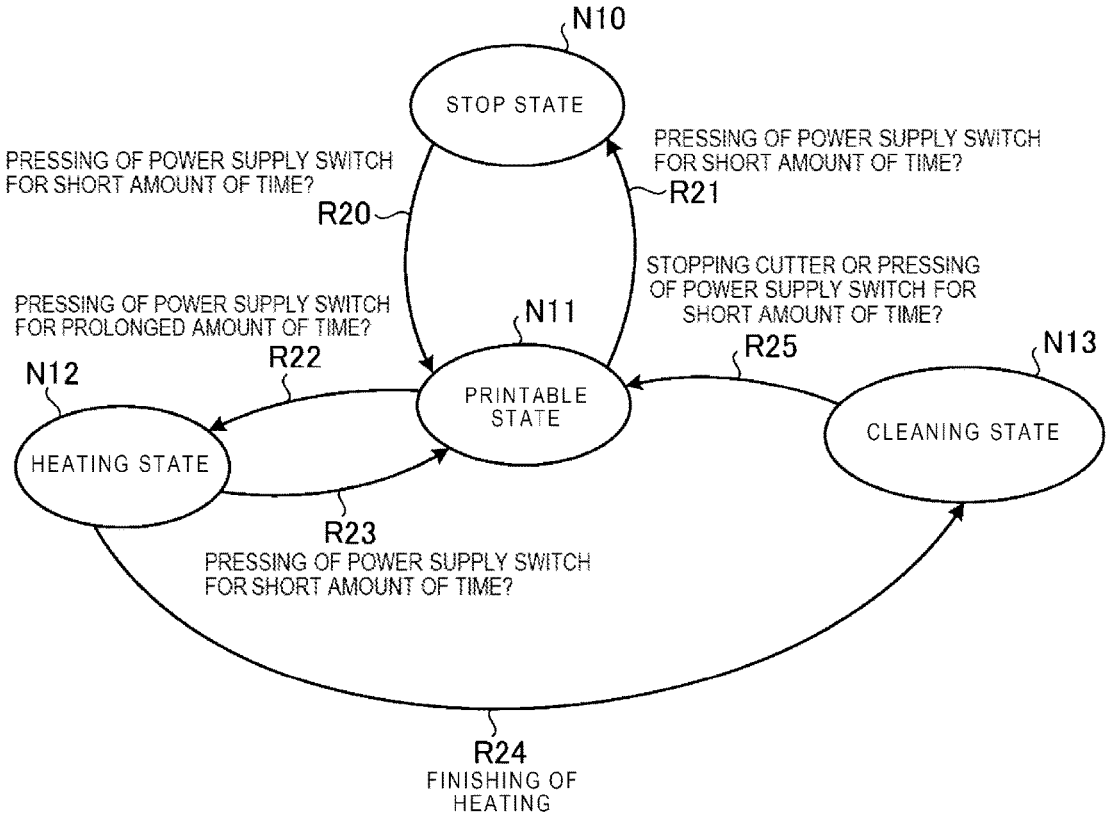
FIG. 7 is a state transition diagram which illustrates a transition of an operation state of the label printer according to a second embodiment.

A state transition of the label printer 10*a* will be described using FIG. 7. FIG. 7 is a state transition diagram which illustrates a transition of an operation state of the label printer 10*a* in the second embodiment.

The label printer 10*a* has four types of states illustrated in FIG. 7. That is, a stop state N10, a printable state N11, a heating state N12, and a cleaning state N13.

The stop state N10 is the same as the above described stop state N1 (refer to FIG. 5) in the label printer 10. The printable state N11 is the same as the above described printable state N2 (refer to FIG. 5) in the label printer 10. In addition, the heating state N12 is the same as the above described heating state N3 (refer to FIG. 5) in the label printer 10.

The cleaning state N13 is a state in which each unit of the thermal head 12, the platen roller 14, and the cutter 16 is cleaned. According to the first embodiment, a part of cleaning is performed by the operator of the label printer 10 himself or herself; however, in the second embodiment, cleaning of the above described each unit is performed without any manpower.

While in the stop state N10, the printer 10*a* transitions to the printable state N11, under a condition that the power supply switch 20 is pressed for a short amount of time (Arc R20). In addition, while in the printable state N11, the label printer 10*a* transitions to the stop state N10, when the power supply switch 20 is pressed for a short amount of time (Arc R21).

While in the printable state N11, the label printer 10*a* transitions to the heating state N12, while the power supply switch 20 is pressed for a prolonged amount of time (Arc R22).

While in the heating state N12, the label printer 10*a* transitions to the printable state N11, when the power supply switch 20 is pressed for a short amount of time (Arc R23).

While in the heating state N12, the label printer 10*a* transitions to the cleaning state N13, when heating of the thermal head 12 and the platen roller 14 are finished (Arc R24).

While in the cleaning state N13, the label printer 10*a* transports a sheet (printing sheet or cleaning sheet), to perform cleaning of the surfaces of the thermal head 12 and the platen roller 14, and each unit of the cutter 16. At this time, since the surface of the thermal head 12 and the surface of the platen roller 14 are heated up to a predetermined temperature, any glue of the label paper P which is stuck to the thermal head 12 and the platen roller 14 is softened by being warmed. Since an adhesive force of the glue which is softened by being warmed decreases, the glue is scraped off by the transported sheet. In addition, since the transported sheet is cut by the cutter 16, the glue which is stuck to the surface of the cutter 16 is removed. In addition, the controller transitions to the printable state N11, when the operation of the cutter 16 is stopped, or the power supply switch 20 is pressed for a short amount of time (Arc R25).

Descriptions of Processing Flow in Second Embodiment

Figure 8:
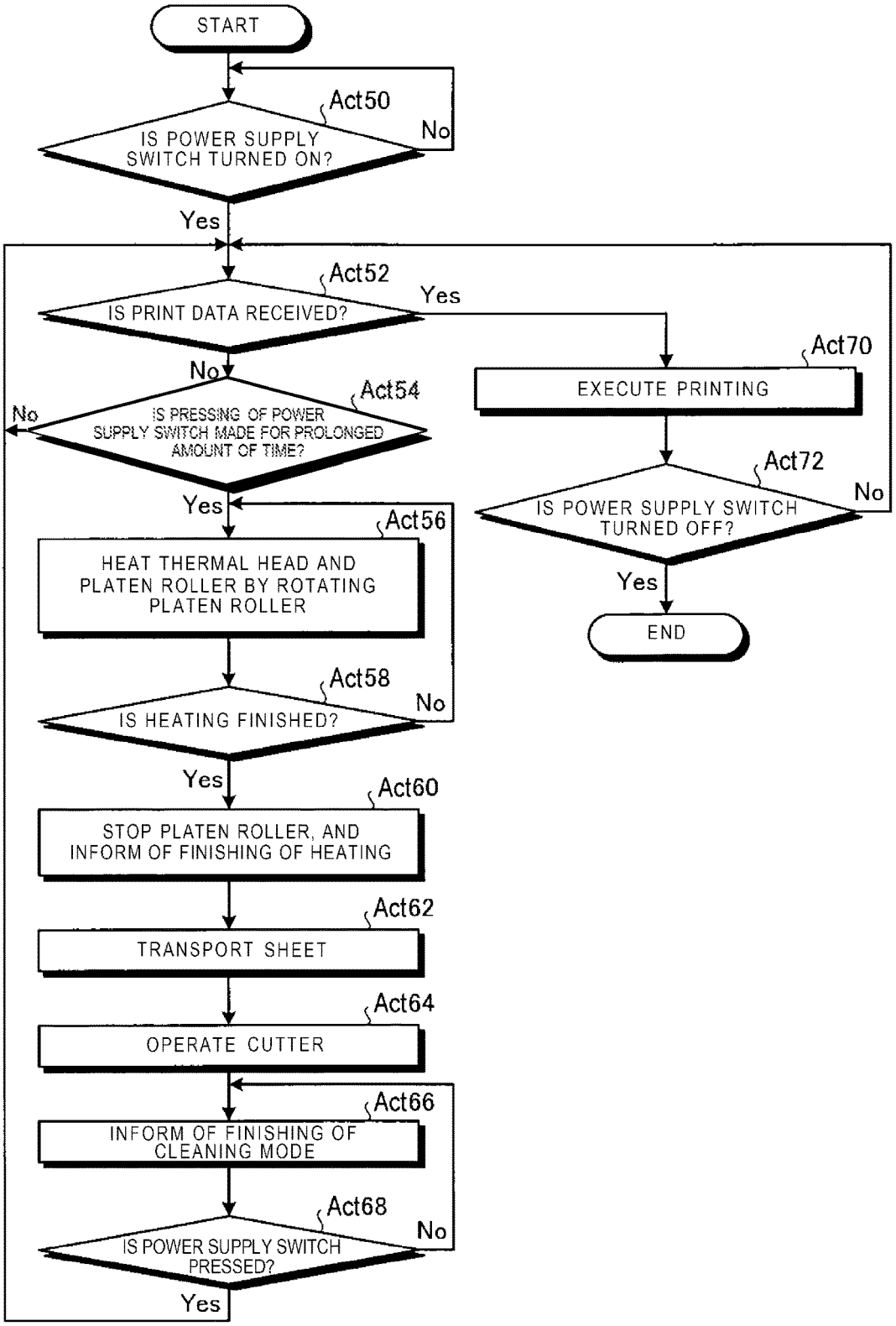
FIG. 8 is a flowchart which illustrates a series of flow of a cleaning mode according to the second embodiment.

Subsequently, a flow of the cleaning mode performed by the label printer 10*a* according to the second embodiment will be described using FIG. 8. FIG. 8 is a flowchart which illustrates a series of flow of the cleaning mode in the second embodiment. The steps of the flowchart in FIG. 8 are executed by the above described controller 19 (refer to FIG. 3).

The controller 19 determines whether the power supply switch 20 is in the ON state, that is, whether the operator of the label printer 10*a* turned on the power supply switch 20 (ACT 50). When the power supply switch 20 is in the ON state (Yes in ACT 50), the controller proceeds to ACT 52 (corresponding to Arc R20 in FIG. 7). On the other hand, when the power supply switch 20 is in the OFF state (No in ACT 50), the controller repeats ACT 50.

In ACT 50, when the power supply switch 20 is in the ON state (Yes in ACT 50), the controller 19 checks whether print data is received from the POS terminal, for example, to which the label printer 10*a* is connected (ACT 52). When the print data is received (Yes in ACT 52), the controller proceeds to ACT 70. On the other hand, when the print data is not received (No in ACT 52), the controller proceeds to ACT 54.

In ACT 52, when the print data is not received (No in ACT 52), the controller 19 determines whether the power supply switch 20 is pressed for a prolonged amount of time (ACT 54). When the power supply switch 20 is pressed for the prolonged amount of time (Yes in ACT 54), the controller proceeds to ACT 56 (corresponding to Arc R22 in FIG. 7). In addition, when the power supply switch 20 is not pressed for the prolonged amount of time in ACT 54 (No in ACT 54), the controller returns to ACT 52.

In ACT 54, when the power supply switch 20 is pressed for the prolonged amount of time (Yes in ACT 54), the controller 19 causes the thermal head 12 to be heated while causing the platen roller 14 to be rotated and to come into contact with the thermal head 12 (ACT 56). In addition, though it is not described in FIG. 8, when the power supply switch 20 is pressed for a short amount of time while in the state in ACT 56, the controller stops heating, and proceeds to ACT 52 (corresponding to Arc R23 in FIG. 7).

Subsequently, the controller 19 determines whether heating of the thermal head 12 is ended, that is, whether the thermal head is heated up to a predetermined temperature (ACT 58). When heating of the thermal head 12 is finished (Yes in ACT 58), the controller proceeds to ACT 60. On the other hand, when heating of the thermal head 12 is not finished (No in ACT 58), the controller returns to ACT 56.

When heating of the thermal head 12 is finished (Yes in ACT 58), the controller 19 stops the rotation of the platen roller 14, and provides an indication that heating of the thermal head 12 is ended, by causing the indicator 22 to blink using a predetermined pattern (ACT 60). In addition, the label printer 10*a* transitions to the cleaning mode (corresponding to Arc R24 in FIG. 7).

Subsequently, the controller 19 transports a sheet (printing sheet or cleaning sheet) loaded in the label printer 10*a* by rotating the platen roller 14 (ACT 62).

In addition, the controller 19 causes the cutter 16 to be operated (ACT 64). At this time, it is preferable that the controller 19 cause the cutter 16 to be repeatedly operated a plurality of times. In this manner, the label printer 10*a* cleans the respective surfaces of the thermal head 12, the platen roller 14, and the cutter 16 using the transported sheet. In addition, the sheet which is cut by the cutter 16 is discharged from the paper discharge port 18.

When the operation of the cutter 16 is finished, the controller 19 causes the indicator to indicate that the cleaning mode is ended by causing the indicator 22 to blink using a predetermined pattern (ACT 66).

The controller 19 determines whether the power supply switch 20 is pressed for a short amount of time (ACT 68). When the power supply switch 20 is pressed (Yes in ACT 68), the controller proceeds to ACT 52 (corresponding to Arc R25 in FIG. 7). On the other hand, when the power supply switch 20 is not pressed (No in ACT 68), the controller returns to ACT 664.

In the above described ACT 52, when the label printer 10*a* received print data (Yes in ACT 52), the controller 19 executes printing of the print data (ACT 70).

Subsequently, the controller 19 checks a state of the power supply switch 20, determines whether the power supply switch 20 is in the OFF state, that is, whether the operator of the label printer 10*a* turned off the power supply switch 20 (ACT 72). When the power supply switch 20 is in the OFF state (Yes in ACT 72), the processing in FIG. 8 is finished (corresponding to Arc R21 in FIG. 7). On the other hand, when the power supply switch 20 is not in the OFF state (No in ACT 72), the controller returns to ACT 52.

As described above, according to the label printer 10*a* in the second embodiment, the platen roller 14 transports a sheet to the label printer 10*a* by being rotated, when heating of the thermal head 12 and the platen roller 14 are finished, and a notification by the indicator 22 is performed. Accordingly, it is possible to easily clean the portion with which the label paper P comes into contact, when a printing sheet or cleaning sheet is transported inside the label printer 10*a*. In particular, according to the label printer 10*a*, it is possible to perform cleaning, without performing opening or closing of the upper case 3.

In addition, according to the label printer 10*a* according to the second embodiment, the cutter 16 cuts a sheet transported according to a rotation of the platen roller 14. Accordingly, it is possible to reliably and easily remove glue which is stuck to the cutter 16.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the cleaning method according to the first embodiment, and the cleaning method according to the second embodiment may be used together. For example, cleaning using the method in the second embodiment in which manual cleaning is not necessary may be performed once a day, and cleaning using the method in the first embodiment may be performed, in which cleaning using wiping which is more elaborate can be performed with a predetermined interval of once a week, or the like.

What is claimed is:

1. A printing apparatus which performs printing on a sheet including adhesive label paper, comprising:

a thermal head configured to perform printing on the sheet using heat;

a platen roller which is positioned to face the thermal head, and configured to rotate to transport the sheet when the sheet is interposed between the thermal head and the platen roller;

a heating unit configured to heat the thermal head;

an output device; and a controller configured to operate in a cleaning mode, in which the controller causes the thermal head to be heated to a predetermined temperature at which glue of the label paper is softened while the platen roller is in contact with the thermal head and rotating without transporting any sheet, and controls the output device to indicate that the thermal head has been heated up to the predetermined temperature and is ready for cleaning.

2. The apparatus according to claim 1, further comprising:

a lower case in which the platen roller is housed; and an upper case in which the thermal head is housed, wherein the upper case opens to provide cleaning access to the thermal head and the platen roller.

3. The apparatus according to claim 2, further comprising:

a switch, which when pressed while the upper case is opened, causes the platen roller to rotate while separated from the thermal head or to stop rotating while separated from the thermal head.

4. The apparatus according to claim 3, further comprising:

a cutting unit configured to cut the sheet which is transported by the platen roller through a nip between the thermal head and the platen roller, wherein a cleaning sheet is transported through the nip to the cutting unit where the cutting unit performs cutting on the cleaning sheet to be cleaned by the cutting sheet.

5. The apparatus according to claim 4, wherein the cleaning sheet is transported by the platen roller through the nip between the thermal head and the platen roller to the cutting unit, when the switch is operated to stop rotation of the platen roller while the upper case is opened, and the upper case is subsequently closed.

6. The apparatus according to claim 1, wherein after the thermal head has been heated up to the predetermined temperature, the controller causes a cleaning sheet to be transported by the platen roller through the nip between the thermal head and the platen roller to clean the thermal head and the platen roller.

7. The apparatus according to claim 6, further comprising:

a cutting unit configured to cut the cleaning sheet which is transported by the platen roller through the nip between the thermal head and the platen roller to be cleaned by the cutting sheet.

8. The apparatus according to claim 1, further comprising:

a power supply switch, which when operated, causes the controller to operate in the cleaning mode.

9. A method of cleaning a printing apparatus which performs printing on a sheet including adhesive label paper, the printing apparatus including a thermal head configured to perform printing on the sheet using heat, a platen roller which is positioned to face the thermal head, and configured to rotate to transport the sheet when the sheet is interposed between the thermal head and the platen roller, and a heating unit configured to heat the thermal head, said method comprising:

pressing a power switch to enter into a cleaning mode;

heating the thermal head to a predetermined temperature at which glue of the label paper is softened, while the platen roller is in contact with the thermal head and rotating without transporting any sheet; and outputting an indication that the thermal head has been heated up to the predetermined temperature and is ready for cleaning.

10. The method according to claim 9, wherein the printing apparatus further comprises:

a lower case in which the platen roller is housed; and an upper case in which the thermal head is housed, wherein the upper case opens to provide cleaning access to the thermal head and the platen roller.

11. The method according to claim 10, further comprising while the upper case is opened, causing the platen roller to rotate while separated from the thermal head in response to a pressing of a switch or to stop rotating while separated from the thermal head in response to the pressing of the switch.

12. The method according to claim 11, wherein the printing apparatus further comprises a cutting unit configured to cut the sheet which is transported by the platen roller through the nip between the thermal head and the platen roller, said method further comprising:

transporting a cleaning sheet through the nip to the cutting unit by rotating the platen roller; and cutting the cleaning sheet by the cutting unit to clean the cutting unit.

13. The method according to claim 12, wherein the cleaning sheet is transported by the platen roller through the nip between the thermal head and the platen roller to the cutting unit, when the switch is pressed to stop rotation of the platen roller while the upper case is opened, and the upper case is subsequently closed.

14. The method according to claim 9, further comprising:

after the thermal head has been heated up to the predetermined temperature, transporting a cleaning sheet to be transported by the platen roller through the nip between the thermal head and the platen roller to clean the thermal head and the platen roller.

15. The method according to claim 14, wherein the printing apparatus further comprises a cutting unit configured to cut the sheet which is transported by the platen roller through the nip between the thermal head and the platen roller, said method further comprising transporting a cleaning sheet through the nip to the cutting unit by rotating the platen roller; and cutting the cleaning sheet by the cutting unit to clean the cutting unit.

* * * * *